US005893555A

United States Patent [19]

Kawada et al.

[11] Patent Number: 5,893,555

[45] Date of Patent: Apr. 13, 1999

[54] SHEET FEEDING APPARATUS

[75] Inventors: Sunichirou Kawada; Yoshihiro Noguchi, both of Ibaraki, Japan

[73] Assignee: Riso Kagaku Corporation, Tokyo, Japan

[21] Appl. No.: 08/617,569

[22] Filed: Mar. 19, 1996

[30] Foreign Application Priority Data

Mar. 20, 1995 [JP] Japan ..... 7-060705

[51] Int. Cl.[6] ..... B65H 3/06

[52] U.S. Cl. ..... 271/117; 271/121; 271/126; 271/155

[58] Field of Search ..... 271/110, 117, 271/121, 124, 126, 152, 154, 155

[56] References Cited

U.S. PATENT DOCUMENTS

| | | | |
|---|---|---|---|
| 3,981,497 | 9/1976 | Feinstein, Jr. et al. | 271/117 |
| 4,811,940 | 3/1989 | Goeltz | 271/155 |
| 5,228,677 | 7/1993 | Asakawa | 271/126 |
| 5,375,826 | 12/1994 | Flores | 271/10 |

FOREIGN PATENT DOCUMENTS

| | | | |
|---|---|---|---|
| 1147954 | 5/1963 | Germany . | |
| 360244726 | 12/1985 | Japan | 271/110 |
| 0203041 | 9/1986 | Japan | 271/117 |
| 0110029 | 4/1990 | Japan | 271/117 |
| A2190363 | 11/1987 | United Kingdom | B65G 1/08 |

*Primary Examiner*—H. Grant Skaggs
*Attorney, Agent, or Firm*—Sughrue, Mion, Zinn, Macpeak & Seas, PLLC

[57] ABSTRACT

A sheet feeding apparatus includes: a sheet feeding table on which sheets are stacked, the sheet feeding table being vertically movable; a sheet feeding roller mechanism provided in a vertical movement path of the sheet feeding table, the sheet feeding roller mechanism having a roller for feeding the sheets from the sheet feeding table one at a time, the roller being vertically displaceable; a spring for urging the sheet feeding roller mechanism in a direction of downward movement of the sheet feeding table; a detector for detecting when, during the upward movement of the sheet feeding table, the sheet feeding roller mechanism is lifted to a predetermined position against the spring, to stop the upward movement of the sheet feeding table; and a movable member movable and lockable for operating a change-over mechanism for changing the raised position of the sheet feeding roller mechanism which is obtained when the sheet feeding roller mechanism is detected by the detector.

12 Claims, 8 Drawing Sheets

PRIOR ART

PRIOR ART

SHEET FEEDING APPARATUS

BACKGROUND OF THE INVENTION

This invention relates to a sheet feeding apparatus adapted to feed sheets to an image forming machine such as a printer, and more particularly to a sheet feeding apparatus which are able to stably feed different kinds of sheets which is different in paper quality such as thickness and hardness.

FIG. 9 is a side view showing the arrangement of a conventional sheet feeding apparatus 50 which is adapted to feed a number of sheets P to an image forming section (not shown) one after another. The unit 50 has a sheet feeding table 51 on which sheets are stacked. The table 51 is a conventional one which is vertically moved by driving means (not shown).

In the operation of the image forming machine, first the sheet feeding table 51 is moved downwardly, and sheets P are stacked on it. Under this condition, the sheet feeding table 51 is moved upwardly. The stop position where the sheet feeding table 51 thus moved is stopped is detected by a sensor 52 adapted to detect the position of a sheet feeding roller mechanism 53.

The sheet feeding roller mechanism 53 is swingable about a shaft 53*a*. Hence, as the sheet feeding table 51 is moved upwardly, the sheet feeding roller mechanism 53 is lifted through the stack of sheets P, so as to activate the sensor 52 thereby to stop the upward movement of the sheet feeding table 51.

Thus, the sheets P are supplied into the machine one after another by means of a scraper roller 54*a* and a pick-up roller 54*b* in the sheet feeding roller mechanism.

However, the above-described sheet feeding apparatus suffers from a difficulty that it is difficult for the unit to accurately feed sheets which are different in thickness or in hardness; more specifically, sometimes no sheet is supplied to the machine or more than one sheet are supplied to it at the same time.

In the case of FIG. 9, the sheet feeding apparatus is so set that the positional relationship between a stack of hard sheets P1 and the sheet feeding roller mechanism 53; that is, the top of the stack of sheets P1 is in contact with the scraper roller 54*a* under a predetermined pressure, while it is spaced a certain distance from the pick-up roller 54*b*.

However, the sheet feeding apparatus in this state is not applicable for feeding soft sheets P2; that is, it is difficult for the sheet feeding apparatus under this condition to suitably feed the soft sheets P2.

A stack of soft sheets P2 are flexible when compared with a stack of hard sheets, and therefore as shown in FIG. 10 the scraper roller 54*a* of the sheet feeding roller mechanism 53 sinks in the stack of soft sheets P2 as much, and accordingly when the sheet feeding table 51 is moved above the stop position shown in FIG. 9, the sensor is activated. That is, in the case of FIG. 10, the stop position is located above the stop position in the case of FIG. 9.

Hence, the top of the stack of the soft sheets P2 is brought into contact with the pickup roller 54*b* under a pressure, too, as a result of which more than one sheet P2 may be often supplied into the image forming machine at the same time.

On the other hand, if hard sheets P1 are supplied under the same conditions as the soft sheets P2 have been supplied, that is, with the sheet feeding roller mechanism set in the same manner, then another difficulty is involved. The hard sheets P1 are not flexible, and therefore before the sheet feeding table 51, being lifted, reaches the stop position determined for the feeding of soft sheets P2, the sensor 52 is activated, so that the sheet feeding table 51 is stopped below the most suitable position (or the stop position for the feeding of hard sheets).

In this case, the top of the stack of the hard sheets P1 is spaced from the pickup roller 54*b* of the sheet feeding roller mechanism 53. On the other hand, the scraper roller 54*a* tries to move (feed) the hard sheet P1, but cannot give it to the pickup roller 54*b*, merely pushing the end of the hard sheet P1 against the side board 56*a* of the guide board 56; that is, no hard sheet is supplied into the image forming machine.

In general, a hard sheet P1 is large in thickness, while the soft sheet P2 is small in thickness. Hence, if those two kinds of sheets, namely, hard sheets and soft sheets are supplied into the machine with one and the same sheet feeding apparatus 50, the above-described difficulty occurs with the feeding of hard sheets or with the feeding of soft sheets.

Accordingly, an object of the invention is to eliminate the above-described difficulties accompanying a conventional sheet feeding apparatus. More specifically, an object of the invention is to provide a sheet feeding apparatus which can handle both hard sheets and soft sheets and is free from difficulties that no sheets is supplied into an image forming machine and more than one sheet is supplied thereinto at the same time.

SUMMARY OF THE INVENTION

According to a first aspect of the present invention, there is provided a sheet feeding apparatus, comprising: a sheet feeding table on which sheets are stacked, the sheet feeding table being vertically movable; a sheet feeding roller mechanism provided in a vertical movement path of the sheet feeding table, the sheet feeding roller mechanism having a roller means for feeding the sheets from the sheet feeding table one at a time, the roller means being vertically displaceable; urging means for urging the sheet feeding roller mechanism in a direction of downward movement of the sheet feeding table; detecting means for detecting when, during the upward movement of the sheet feeding table, the sheet feeding roller mechanism is lifted to a predetermined position against the urging means, to stop the upward movement of the sheet feeding table; and change-over means having a movable member movable and lockable, wherein the change-over means changes the raised position of the sheet feeding roller mechanism which is obtained when the sheet feeding roller mechanism is detected by the detecting means.

According to a second aspect of the invention, there is provided the sheet feeding apparatus of the first aspect, wherein the detecting means includes a sensor and a detection member to be detected, one of the sensor and the detection body is supported by the sheet feeding roller mechanism, the other is supported by a frame, and, in a direction of movement of the sheet feeding table, a relative position of a detecting section of the sensor and the detection member to be detected is changed according to a position of the movable member.

According to a third aspect of the invention, there is provided the sheet feeding apparatus of the first aspect, wherein the roller means comprises: a first roller firstly applying a feed force to the top of the sheets stacked on the sheet feeding table, and a second roller having a center shaft cooperating with a separating member provided on the frame to separate only the top of the sheets whose front edge portions are shifted from the sheet feeding table by the first roller, and feed the top sheet thus separated from the sheet feeding table, wherein the sheet feeding roller mechanism is pivotally supported by the center shaft.

According to a fourth aspect of the invention, there is provided the sheet feeding apparatus of the first aspect, further comprising: sheet feeding pressure varying means for changing the urging force of the urging means according to a position of the movable member which is applied to the sheet feeding roller mechanism.

Before the sheet feeding operation starts, the sheet feeding table is moved upwardly, and soon the top of the stack of sheets is brought into contact with the sheet feeding roller mechanism under pressure. Thereafter, as the sheet feeding table is moved upwardly, the sheet feeding roller mechanism is also moved upwardly. The movable member of the change-over means is moved according to the paper quality (such as thickness and hardness) of the sheets to be supplied, the sensor of the detecting means or the detection member to be detected is moved to a position corresponding to the position of the movable member. Hence, the raised position of the sheet feeding roller mechanism is changed when the sensor detects the detection member.

The softer the sheets to be supplied, the lower the raised position of the sheet feeding roller mechanism detected by the detecting means; whereas the harder the sheets, the higher the raised position. Upon detection of the raised position of the sheet feeding roller mechanism by the detecting means, the upward movement of the sheet feeding table is stopped.

The force of the depressing means to push the sheet feeding roller mechanism downwardly is changed according to the position of the movable member of the change-over means; that is, the sheet feeding pressure used to press the sheet feeding roller mechanism against the stack of sheets can be adjusted according to the paper quality of sheets to be handled.

The stop position of the sheet feeding roller mechanism, and the sheet feeding pressure used to press the sheet feeding roller mechanism against the stack of sheets can be adjusted according to the paper quality of sheets to be handled. Thus, the sheet feeding apparatus is able to stably feed sheets being free from difficulties that no sheet is supplied into the image forming machine or a plurality of sheets are supplied into the latter at the same time.

BRIEF DESCRIPTION OF THE DRAWINGS

7

DETAILED DESCRIPTION OF THE PREFERRED EMBODIMENTS

Figure 1:
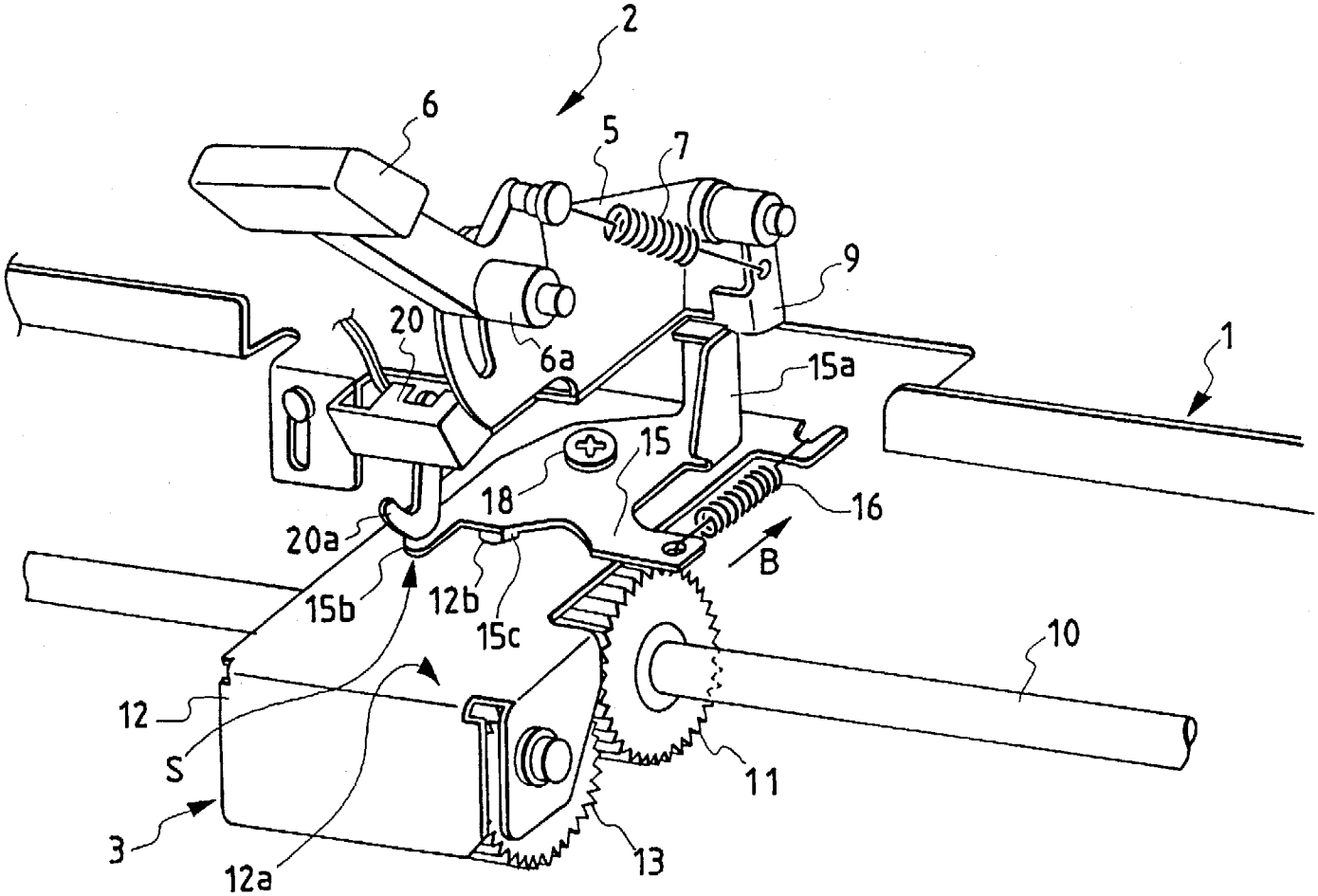
FIG. 1 is a perspective view showing a sheet feeding apparatus according to a first embodiment.
Figure 2:
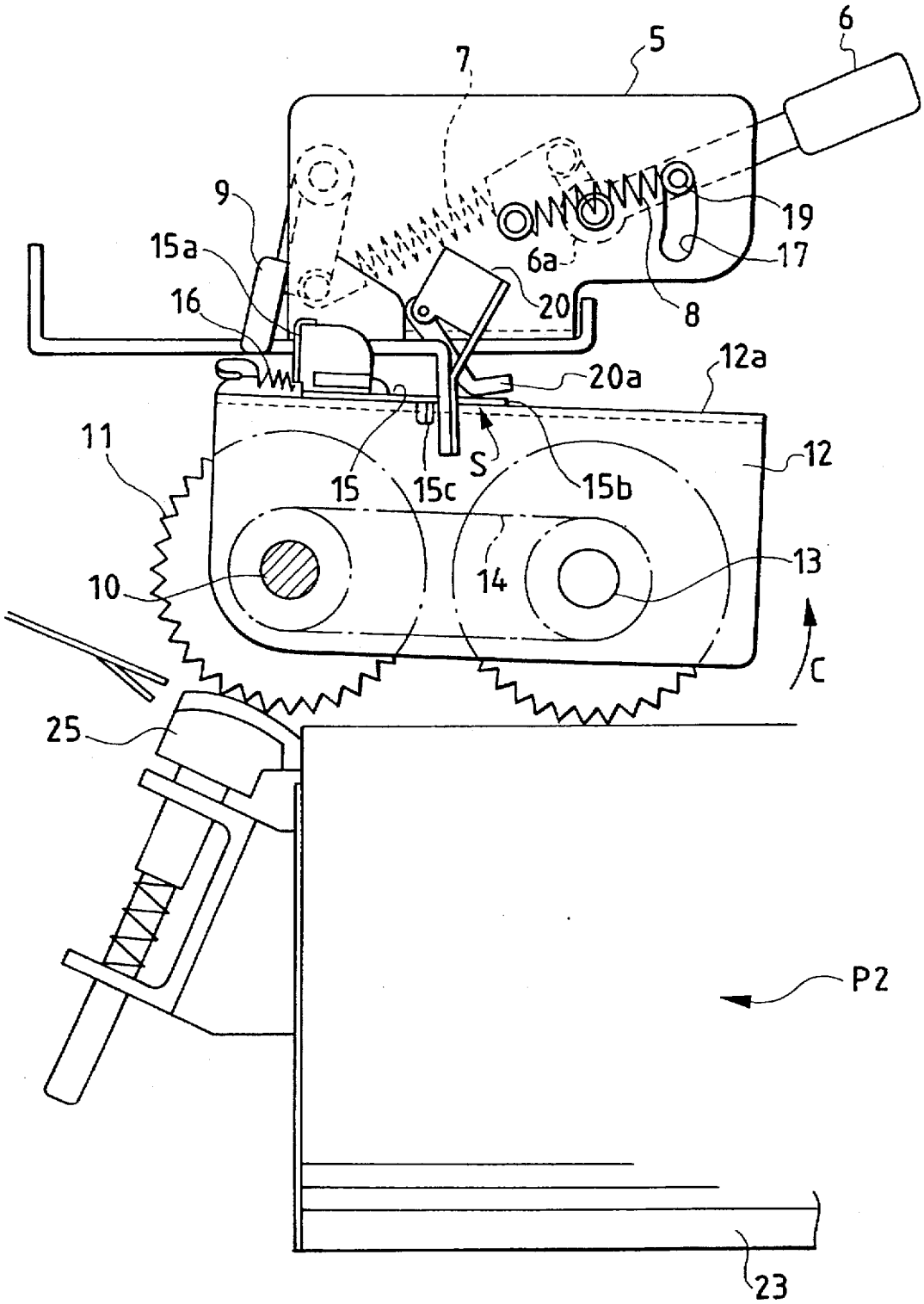
FIG. 2 is a side view of the sheet feeding apparatus shown in FIG. 1, in use of one kind of sheets.
Figure 3:
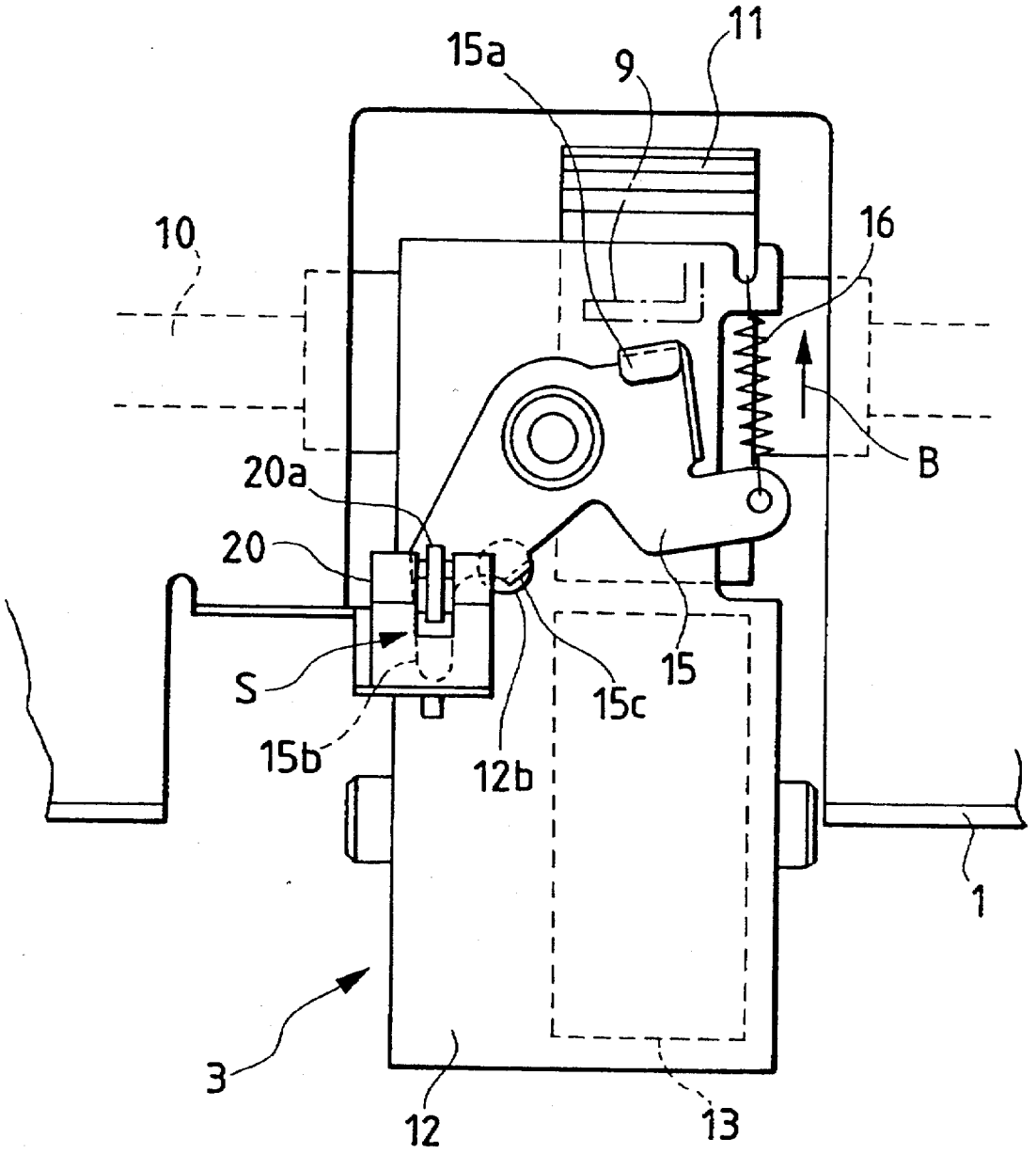
FIG. 3 is a plan view of the sheet feeding apparatus shown in FIG. 2.

FIGS. 1, 2 and 3 are a perspective view, a side view, and a plan view, respectively, showing essential components of a sheet feeding apparatus, which constitutes a first embodiment of the invention.

An image forming machine has a frame 1 and a sheet-feeding-pressure change-over mechanism 2 (a pressure-changing mechanism, when applicable) provided with the frame 1. The pressure-changing mechanism 2 changes the sheet feeding pressure of a sheet feeding roller mechanism 3.

A sheet feeding pressure lever 6 serving as a moving member of change-over means has its base end portion 6*a* which is pivotally supported on a base board 5 which extends from the frame 1. More specifically, the base board 5 has an elongated hole 17 which is in the form of an arc with the base end portion 6*a* as the center. A roller 19 is pivotally supported by the sheet feeding pressure lever 6, and is loosely fitted in the elongated hole 17.

A spring 8 is connected between the substantially middle of the sheet feeding pressure lever 6 and the base board 5, so that the roller 19 is pushed against one end of the elongated hole 17 or the other end thereby to hold the lever 6 selectively at one of the two positions.

Figure 4:
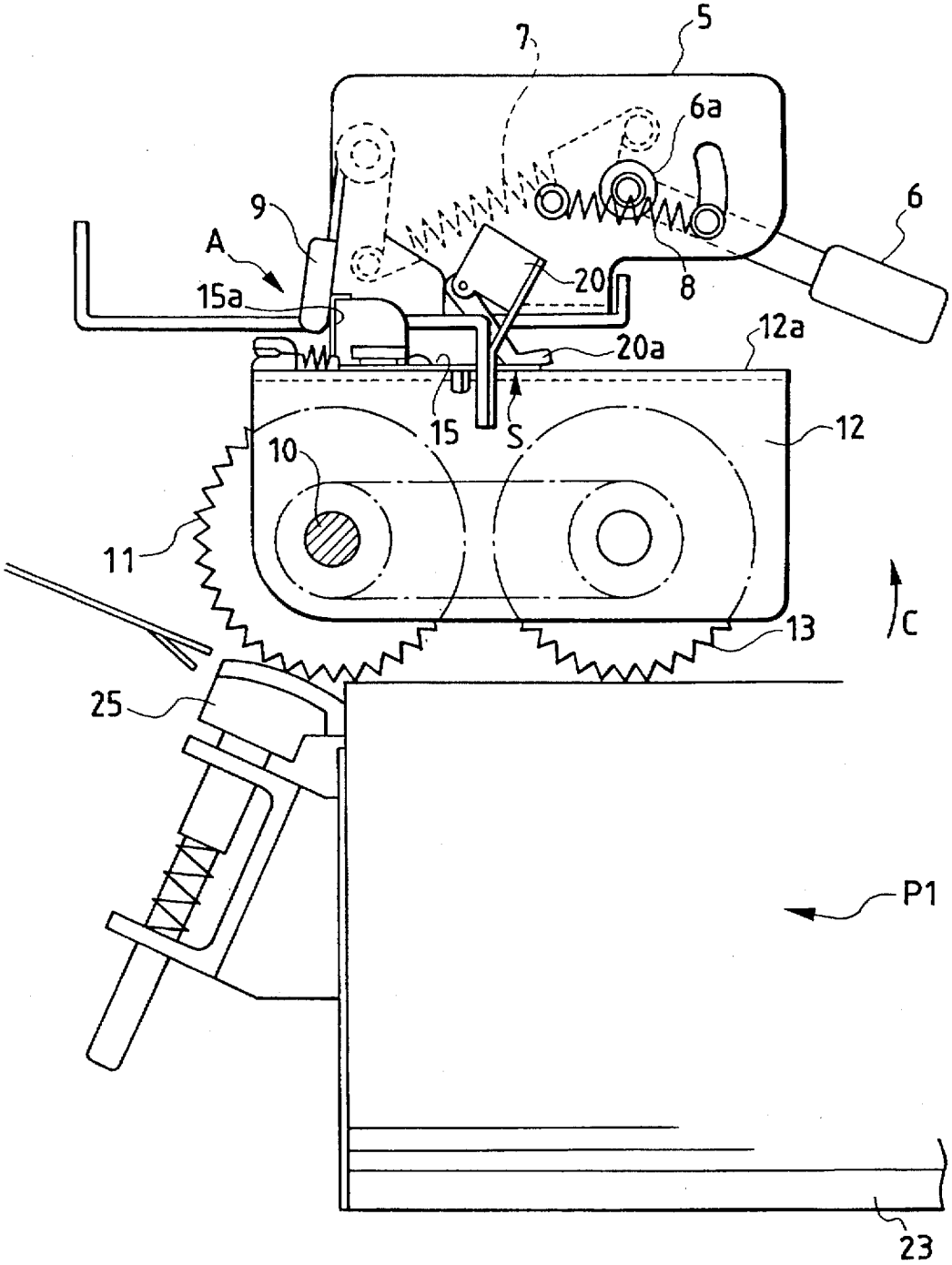
FIG. 4 is a side view of the sheet feeding apparatus in use of another kind of sheet.
Figure 5:
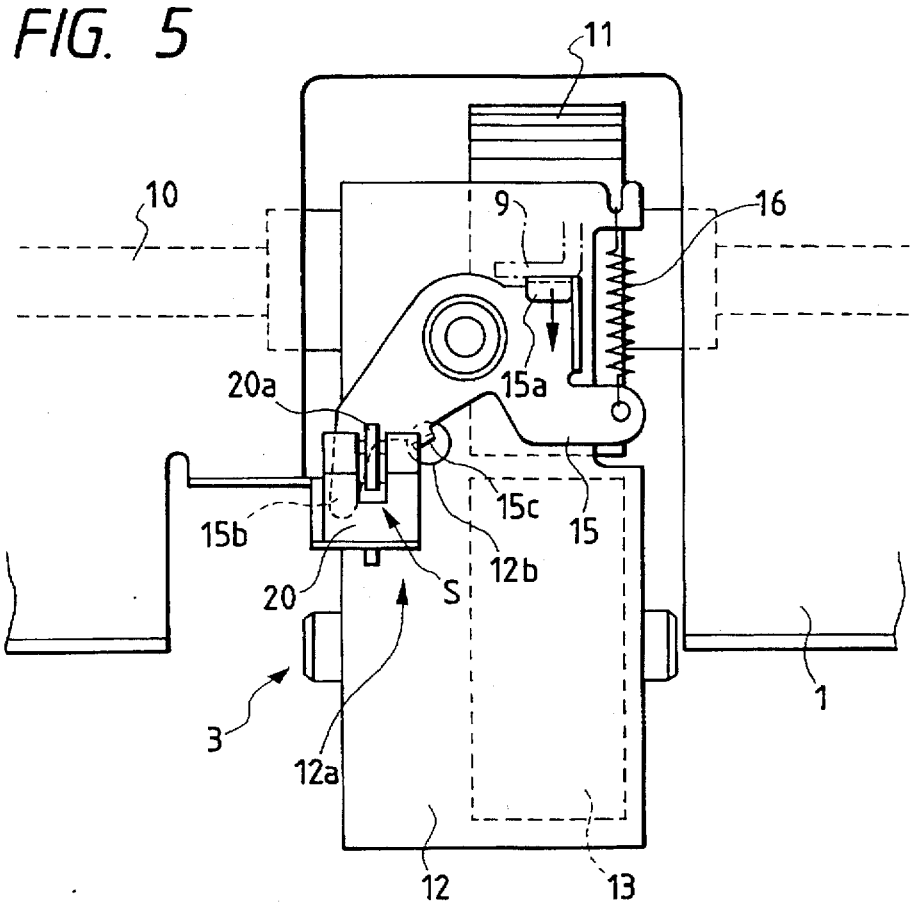
FIG. 5 is a plan view of the sheet feeding apparatus shown in FIG. 4.

A sheet feeding pressure hook 9 is swingably supported at the rear end of the base board 5. A sheet feeding pressure spring 7 is connected between the sheet feeding pressure hook 9 and the sheet feeding pressure lever 6, so that the sheet feeding pressure spring 7 is changed in the amount of strain according to the position where the sheet feeding pressure lever 6 (for instance, the sheet feeding pressure spring in the case of FIG. 4 is greater in the amount of strain than in the case of FIG. 2).

The sheet feeding roller mechanism 3 is pivotally supported by a rotary shaft 10 of the image forming machine. On the rotary shaft 10, a second roller, namely, a pickup roller 11, and a roller-supporting frame 12 in form of the substantially U-shape is mounted. An endless belt 14 is laid over the pickup roller 11 and a scraper roller 13, so that when the rotary shaft 10 is turned, those two rollers 11 and 13 are turned in one and the same direction.

The outer cylindrical surfaces of the rollers 11 and 13 are roughened so that they are brought into positive contact with a sheet P; hence, no slip occurs between the sheet and the rollers.

On the upper surface of the roller-supporting frame 12, a detecting member of detecting means, namely, a swing arm 15 is provided in such a manner that it is swingable about a shaft 18.

The swing arm 15 is kept pulled by a spring 16 in the direction of the arrow B. The swing arm 15 includes a regulating piece 15*c* which is loosely fitted in an opening 12*b* formed in the roller-supporting frame 12.

The swing arm 15 further includes an engaging piece 15*a* at one end which extends upright. The aforementioned sheet feeding pressure hook 9 is pushed against the engaging piece 15*a*.

The swing arm 15 is a plate member having a thickness which is predetermined according to the difference in the amount of compression between predetermined numbers of pieces of hard sheets P1 and soft sheets P2 which are held under suitable pressure. Over the upper surface 12*a* of the roller supporting frame 12, the swing arm 15 has a change-over portion 15*b* which is able to go in and out of the detection position S of a detector 20.

The change-over portion 15*b* is located on the detection position S when the swing arm 15, being pulled by the spring 16, is swung counterclockwise as shown in FIG. 1 or 3. And when the swing arm is swung clockwise with the engaging piece 15*a* being pushed by the sheet feeding pressure hook 9, the change-over section 15*b* is retracted from the detection position S.

In the embodiment shown in FIGS. 1 through 5, the position of the detector 20 is freely adjustable in a vertical direction with respect to the frame 1. The detector 20 has a detecting piece 20*a* extending downwardly. The top of a stack of sheets P is brought into contact with the scraper roller 13 by the upward movement of the sheet feeding table 23. Thereafter, as the table 23 is further moved upwardly, the detecting piece 20*a* is brought into contact with the roller supporting frame 12. In the case where the change-over portion 15*b* of the swing arm 15 has been located over the detection position S of the roller supporting frame 12, the detecting piece 20*a* is brought into contact with the change-over section 15*b*.

The sheet feeding apparatus thus constructed operates as follows:

In the case where sheets (P) to be supplied into the machine are soft sheets P2 (thin and/or soft sheets), the sheet feeding pressure lever 6 is swung to the upper position as shown in FIG. 2. In this case, the sheet feeding pressure hook 9 is not in contact with the swing arm 15, and the change-over portion 15*b* of the latter 15 is located over the detection position S by means of the spring 16.

Next, when the sheet feeding table is moved upwardly on which a plurality of soft sheets P2 have been stacked, the top of the stack of soft sheets P2 is brought into contact with the scraper roller 13.

As a result, the roller-supporting frame 12 is slightly displaced with respect to the rotary shaft (or swung about the rotary shaft 10) in the direction of the arrow C in FIG. 2, and the detecting piece 20*a* of the detector 20 is brought into contact with the change-over section 15*b* of the swing arm 15 (cf. FIG. 3).

In this case, the angle of swing of the roller-supporting frame 12 in the direction of the arrow C is smaller as much as the thickness of the change-over portion 15*b* than in the case where the change-over portion 15*b* is not over the detection position S. In correspondence to the difference in the angle of swing, the position to which the top of the stack of soft sheets P2 is raised can be made lowered.

Hence, the lifting of the sheet feeding table 23 is stopped with the top soft sheet P2 being in contact with the scraper roller 13 under a suitable pressure while forming a predetermined gap with the pickup roller 11. Hence, the sheet feeding apparatus of the invention is free from the difficulties that no sheet is supplied into the machine, and a plurality of pieces of sheets are supplied thereinto at the same time.

That is, upon start of the sheet feeding operation of the sheet feeding roller mechanism 3, the scraper roller 13 applies a sheet feeding force to the top of the stack of sheets P2, so that the front end of the top sheet P2 is fed in between the pickup roller 11 and a separating member 25. Since the separating member 25 is elastically pushed against the pickup roller 11, the force of rotation of the pickup roller 11 and the frictional force of the separating member fetches only the top of the stack of sheets P2. That is, the sheets P2 thus stacked are supplied positively one at a time.

In the case where hard sheets P1 (thick and hard sheets such as drawing paper and cardboard) are to be supplied, the sheet feeding pressure lever 6 is set at the lower position as shown in FIG. 4.

In this operation, the sheet feeding pressure hook 9 is swung in the direction of the arrow A in FIG. 4 with the aid of the sheet feeding pressure spring 7, thus pushing the engaging piece 15*a* of the swing arm 15. As a result, the change-over portion 15*b* of the swing arm 15 is retracted from the detection position S (cf. FIG. 5).

Hence, when the scraper roller 13 is pushed upwardly through the stack of sheets P1 during the upward motion of the sheet feeding table 13, the detecting piece 20*a* of the sensor 20 is brought into direct contact with the upper surface 12*a* of the roller supporting frame 12.

The angle through which the roller supporting frame 12 is swung for the period of time which elapses from the time instant that the top of the stack of sheets P1 is brought into contact with the scraper roller 13 until the sensor 20 is turned on is larger as much as an angle corresponding to the thickness of the change-over portion 15*b* than in the case where the change-over portion 15*b* of the swing arm 15 is located at the detection position S. The force which the sheet feeding pressure spring 7 applies to the roller-supporting frame 12 is also greater. Hence, the top of the hard sheets P1 is brought in contact with the scraper roller 13 under great pressure, while being spaced a predetermined distance (gap) from the pickup roller 11.

After the upward movement of the sheet feeding table 23 is stopped, the top sheet is supplied into the image forming machine by the rotation of the scraper roller 13 and the pickup roller 11. This is applied not only to the feeding of hard sheets P1 but also to the feeding of soft sheets P2.

In the above -described embodiment, the one detector 20, which forms detecting means, is supported by the frame 1, while the detection member to be detected (i.e., the swing arm) 15 is supported by a roller supporting frame 12 of sheet feeding roller mechanism 3, and, in association with the movable member (i.e., the sheet feeding pressure lever) 6 of change-over means the body-to-be-detected 15 is moved to a position which corresponds to the movement position of the movable member 6; however, the invention is not limited thereto or thereby. That is, the above-described embodiment may be so designed that one of the sensor 20 and detection member 15 is supported by the sheet feeding roller mechanism 3, while the other is supported directly or indirectly by the frame 1, and the one of aforementioned sensor and detection member body thus supported is moved to a position which corresponds to the movable member 6 of the change-over means. A typical example of the modification will be described as a second embodiment of the invention below in detail.

Figure 6:
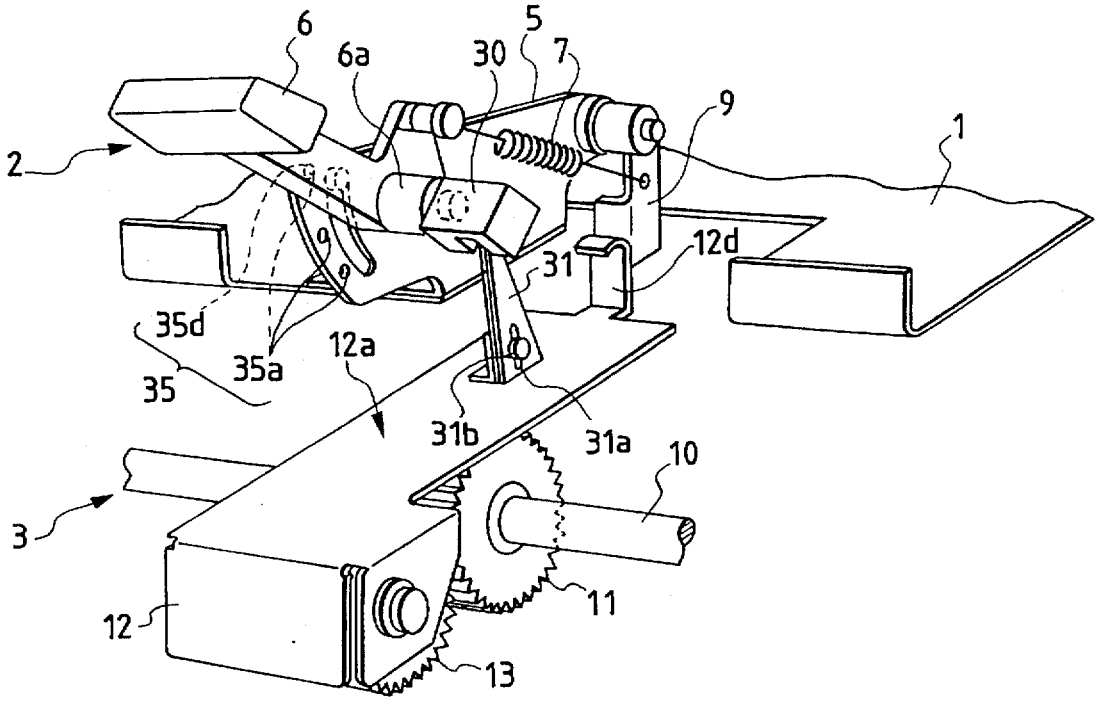
FIG. 6 is a perspective view showing a sheet feeding apparatus according to a second embodiment.

FIG. 6 is a perspective view showing the second embodiment of the invention. In FIG. 6, parts corresponding functionally to those already described with reference to the first embodiment are therefore designated by the same reference numerals or characters.

In the second embodiment, a sensor (or detecting member) 30 is provided at the base end portion 6*a* of a sheet feeding pressure lever 6. The sensor is an optical sensor which is made up of a light emitting unit and a light receiving unit. More specifically, the sensor detects the interception of a light beam which is applied from the light emitter to the light receiving unit. The detection point of the sensor 30 is slightly shifted from the center of the base end portion 6*a* of the sheet feeding pressure lever 6. Hence, the detection point of the sensor 30 may be moved vertically by turning the lever 6.

A plate-shaped detection piece (or body-to-be-detected) 31 is mounted on the upper surface 12*a* of the roller supporting frame 12 in such a manner that the detection piece 31 can be moved in and out of the space between the light emitting unit and the light receiving unit of the sensor. In addition, the vertical position of the detection piece 31 can be freely adjusted with a screw 31*b* inserted into an elongated hole 31*a*. A sheet feeding pressure hook 9, which is moved with the sheet feeding pressure lever 6, is confronted with an engaging piece 12*d* of the roller supporting frame 12.

In the case where the sheet feeding pressure lever 6 is held at the upper position as shown in FIG. 6, the detection point of the sensor is located lower than in the case where the lever 6 is held at the lower position as shown in FIG. 4, and the sheet compressing pressure of the scraper roller 13 pushing the sheets downwardly is lower. Hence, the state shown in FIG. 6 is suitable for feeding soft sheets P2.

When the lever 6 is moved to the lower position, the detection point of the sensor 30 is moved upwardly, the sheet compressing pressure of the scraper roller 13 is increased. This state is suitable for feeding hard sheets P1.

Figure 7:
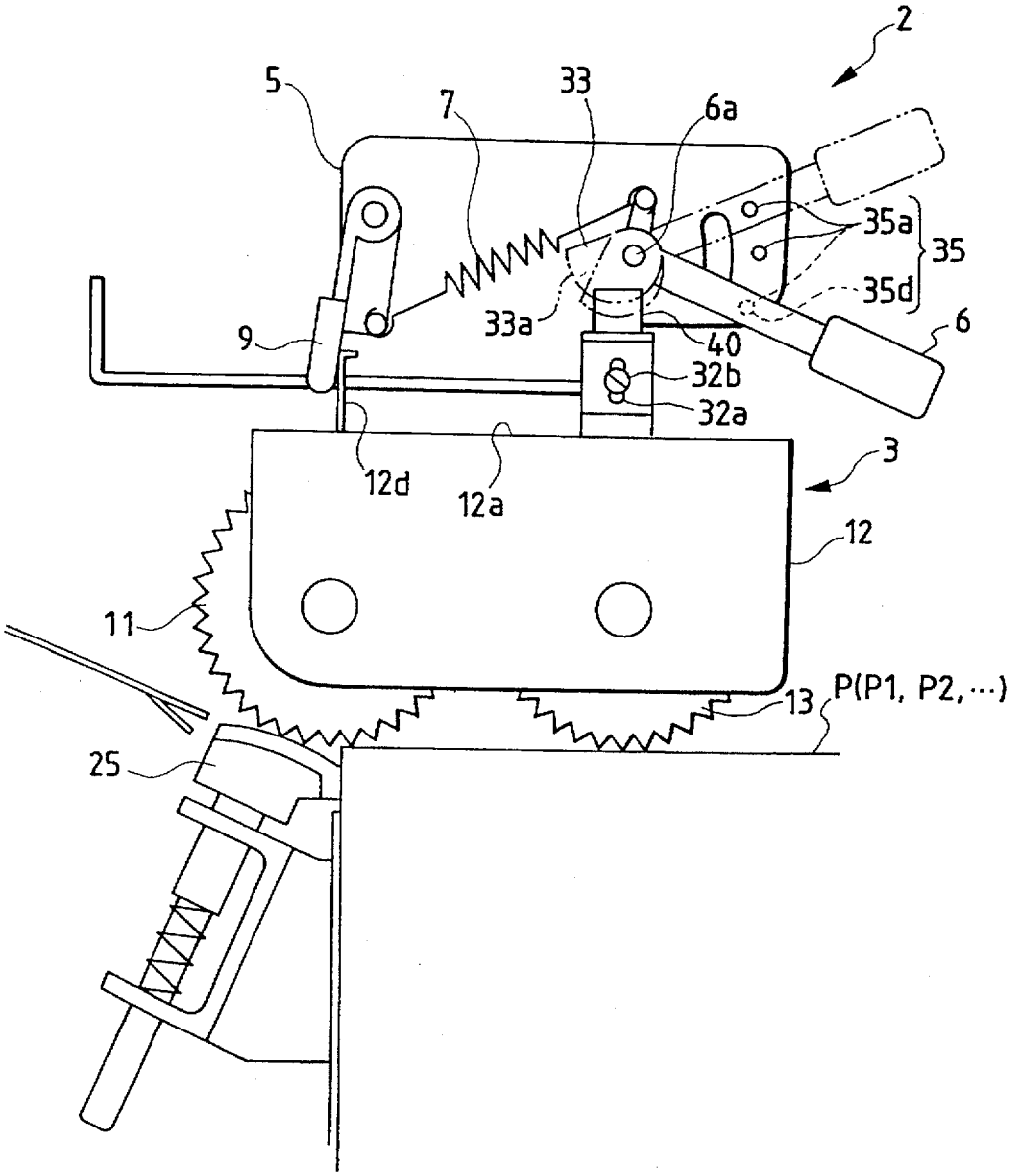
FIG. 7 is a side view of the sheet feeding apparatus according to a third embodiment.

FIG. 7 is a perspective view showing another example of the sheet feeding apparatus, which constitutes a third embodiment of the invention.

In the third embodiment, its sheet feeding pressure lever 6 has a detection piece (or a body to be detected) 33 at the base end 6*a*. The detection piece 33 has an edge portion 33*a* whose configuration is eccentric with respect to the center of the base end 6*a*.

A sensor (or detecting member) 40 is provided on the upper surface 12*a* of a roller supporting frame 12. The sensor 40 is made up of a light emitting unit and a light receiving unit, to detect the interception of a light beam which is applied by the light emitting unit to the light receiving unit.

As the sheet feeding pressure lever 6 is turned, the edge portion 33*a* of the detection piece 33 is moved vertically with respect to the detection point of the sensor 40.

The height of the sensor 40 can be freely adjusted with a screw 32*b* engaged with an elongated hole 32*a*.

Hence, in the case where the sheet feeding pressure lever 6 is set at the position indicated by the two-dot chain lines in FIG. 7, the detection point of the sensor 40 is located lower than in the case where the lever 6 is at the position indicated by the solid line. Therefore, in this operation, although the scraper roller 13 is pushed against the stack of sheets, the sheet feeding pressure provided is low, thus being suitable for handling soft sheets P2.

In the case where the sheet feeding pressure lever 6 is set at the position indicated by the solid-lines, the sheet feeding pressure is provided which is high enough to feed hard sheets P1.

In the third embodiment, similarly as in the above-described embodiment, no swing arm 15 is employed, and the sheet feeding pressure lever 6 is operated (swung) separately according to the hardness (or thicknesses) of sheets to be supplied, so that the edge portion 33*a* of the detection piece 33 is shifted vertically, whereby the sheet feeding roller mechanism provides a most suitable contact pressure for a stack of sheets (P1 or P2).

Hence, with the third embodiment, similarly as in the above-described embodiments, the sheet feeding operation is achieved with high stability; that is, it is free from the difficulties that no sheet is supplied to the image forming machine or a plurality of sheets are supplied thereinto at the same time.

In each of the above-described embodiments, the spring 8 is employed to switch the hard sheet (P1) feeding operation and the soft sheet (P2) feeding operation over to each other; however, the invention is not limited thereto or thereby. That is, the sheet feeding apparatus may be so modified that it can handle sheets whose hardness is between the soft sheet P2 and the hard sheet P1 (hereinafter referred to as "intermediate sheets", when applicable).

For this purpose, for the sheet feeding pressure lever, intermediate positions are provided between the upper position and the lower position, for feeding the intermediate sheets. In addition, it is necessary to provide another clicking mechanism to hold the sheet feeding pressure lever 6 at the intermediate position in addition to the upper and lower positions.

Figure 8:
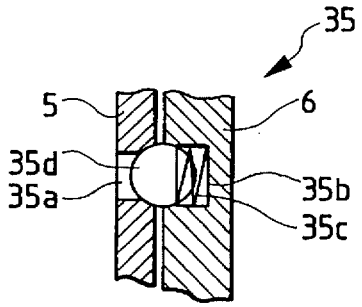
FIG. 8 is a sectional view showing a clicking mechanism in a sheet feeding pressure lever.
Figure 9:
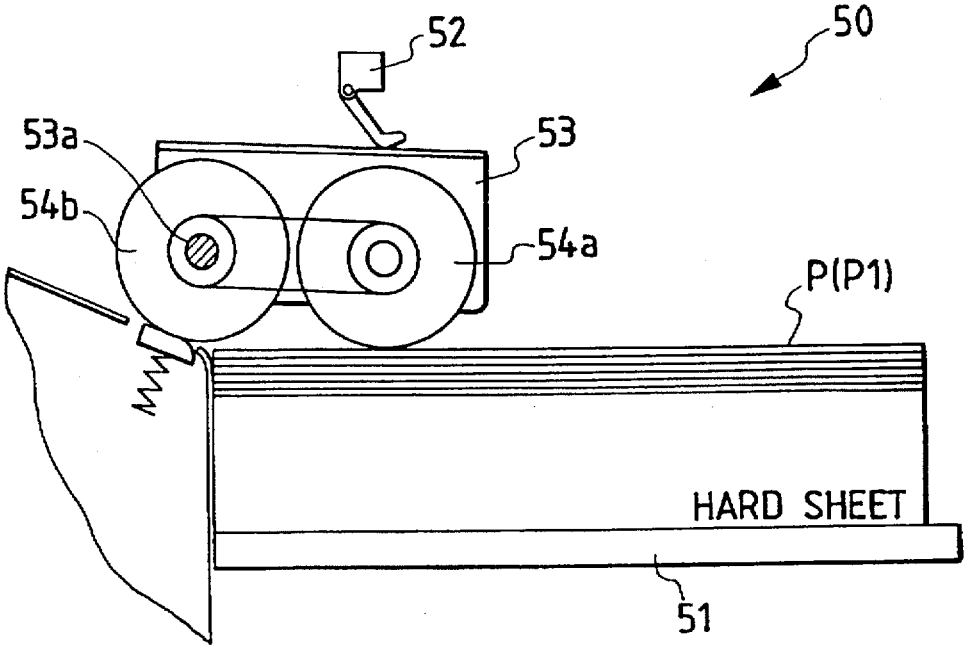
FIG. 9 is a side view of a conventional sheet feeding apparatus (which is so set as to handle hard sheets)
Figure 10:
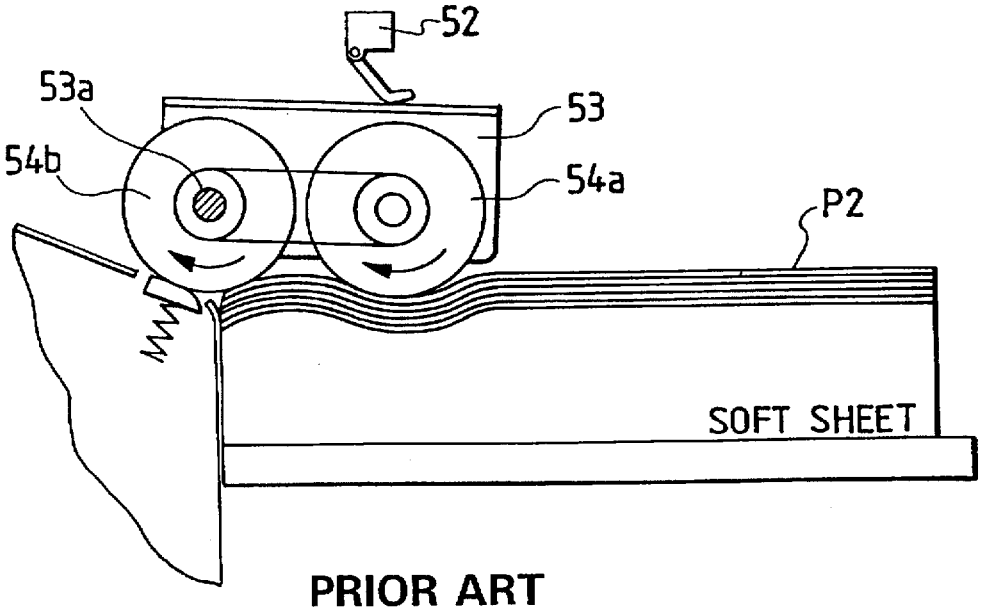
PRIOR ART FIG. 10
FIG. 10 is a side view of the conventional sheet feeding apparatus of FIG. 9 which tries to feed soft sheets.
Figure 11:
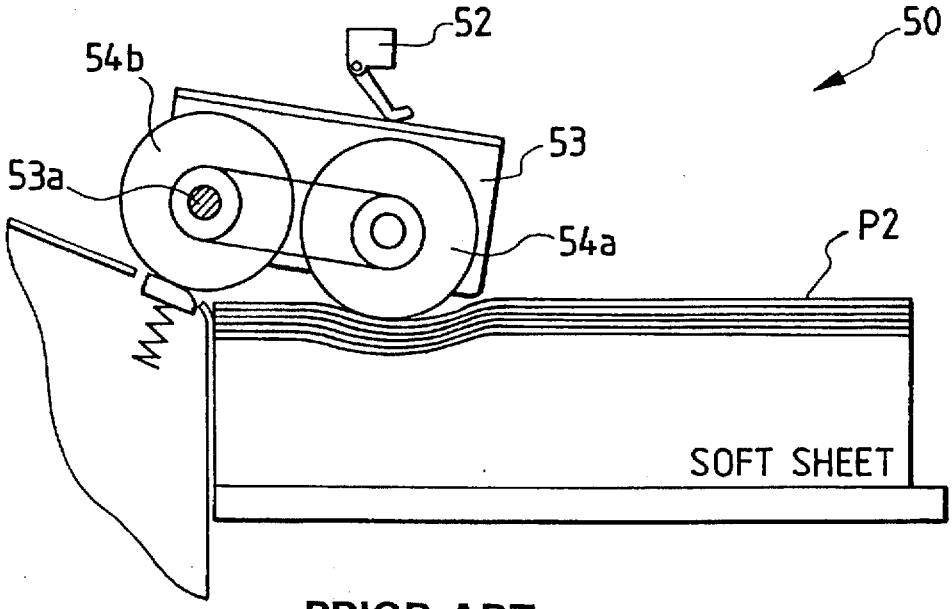
FIG. 11 is a side view of the conventional sheet feeding apparatus (which is so set as to handle soft sheets)
Figure 12:
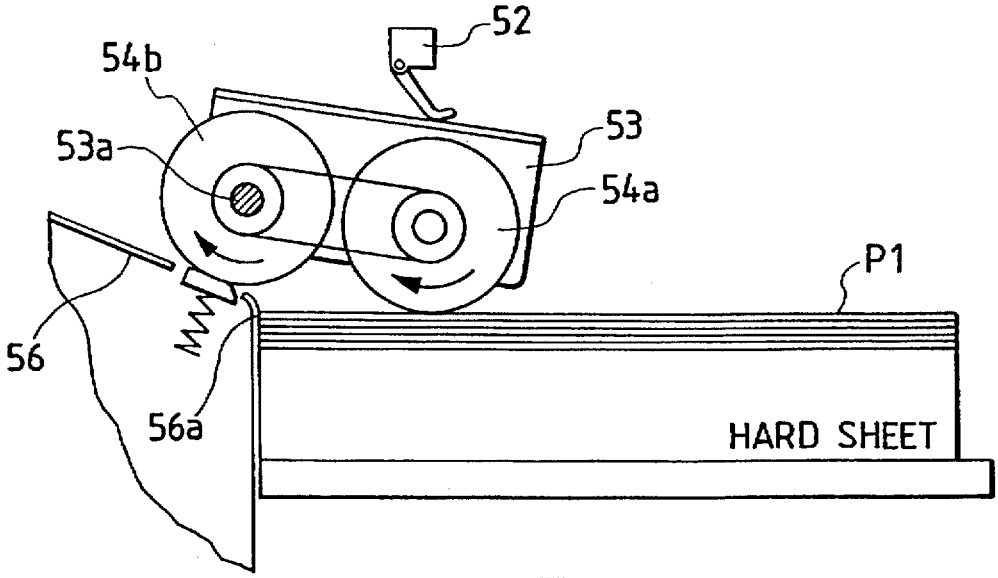
PRIOR ART FIG. 12
FIG. 12 is a side view of the conventional sheet feeding apparatus of FIG. 11 which tries to feed hard sheets.

The aforementioned clicking mechanism is generally indicated at 35 in FIG. 8, a sectional view. A recess 35*b* is formed in the sheet feeding pressure lever 6 which is confronted with the base board 5, and then a ball 35*d* is set in the recess 35*b* together with a spring 35*c*. On the other hand, an engaging groove 35*a* is formed in the base board 5 at the middle of the stroke of the sheet feeding pressure lever 6.

Hence, the sheet feeding pressure lever 6 can be held stopped at the intermediate position with the ball 35*d* engaged with the engaging groove 35*a* being urged by the spring 35*c*. With the lever 6 set in this manner, a contact pressure suitable for standard sheets which are ranked in hardness (or in thickness) between the hard sheets P1 and the soft sheets P2, can be obtained.

The employment of the clicking mechanism 35 may dispense with the clicking spring 8. However, it should be noted that, in this case, as shown in FIGS. 6 and 7, engaging grooves 35*a* are formed in the base board 5 at the upper and lower positions of the sheet feeding pressure lever 6, respectively.

With the sheet feeding apparatus thus modified, the sheet feeding pressure lever 6 can be held at the upper position, the lower position, and the intermediate position.

As was described above, with the clicking mechanism, the sheet feeding pressure lever (or the operating section of the change-over means) 6 can be shifted to more than two positions and locked there. In this connection, in the case of the first embodiment, surfaces different in height are formed in the upper surface of the change-over section 15*b* of the swing arm 15 in correspondence to the number of the lever locking positions. Of those surfaces thus formed in the change-over section 15*b*, the lowest surface may be replaced with the upper surface of the roller supporting frame 12.

As was described above, the sheet feeding apparatus of the invention is so designed that the raised position of the sheet feeding roller mechanism which is obtained when the sheet feeding roller mechanism is detected by the detecting means is changed according to the position where the operating section of the change-over means is locked after being moved, and that, in the case where the operating section is locked at the position corresponding to thin and soft sheets, the sheet feeding roller mechanism is detected at a relatively low position; whereas in the case where the operating section is locked at the position corresponding to thick and hard sheets, the sheet feeding roller mechanism is detected a relatively high position. On the other hand, in the case where, as the sheet feeding table is moved upwardly, the stack of sheets is pressed against one of the rollers in the sheet feeding roller mechanism, the amount of compression or deformation of the stack of sheet depends on the thickness and/or hardness of the sheets. Even in this case, the positional relationship between the upper surface of the stack of sheets and the other roller in the sheet feeding roller mechanism is maintained suitably. Hence, the sheet feeding apparatus of the invention is able to stably feed sheets being free from difficulties that no sheet is supplied into the image forming machine or a plurality of sheets are supplied thereinto at the same time.

Furthermore, the sheet feeding apparatus includes the sheet feeding pressure changing means which controls the force of the urging means to press the sheet feeding roller mechanism downwardly according to the difference in paper quality such as thickness and hardness of sheets to be handled. That is, the sheet feeding pressure changing means increases the force of the urging means in the case where sheets to be supplied are thick and hard, and decreases it in the case where sheets to be supplied are thin and soft. That is, the sheet feeding pressure provided when the stack of sheets is pushed against the rollers of the sheet feeding roller mechanism can be adjusted according to the paper quality of sheets to be handled. This feature makes it possible to perform the sheet feeding operation more stable.

Furthermore, according to the invention, the detection position of the sheet feeding roller mechanism, and the sheet feeding pressure can be adjusted with only one operating means; that is, a difficulty is eliminated that it is necessary to provide operating means not only for the adjustment of the detection position but also for the adjustment of the sheet feeding pressure. This means that the sheet feeding apparatus is simplified as much, and can be operation with ease; that is, it is high in operability.

What is claimed is:

1. A sheet feeding apparatus, comprising:

a sheet feeding table on which sheets are stacked, said sheet feeding table being vertically movable;

a sheet feeding roller mechanism provided in a vertical movement path of said sheet feeding table, said sheet feeding roller mechanism having roller means for feeding the sheets from said sheet feeding table one at a time, said roller means being vertically displaceable;

urging means for urging said sheet feeding roller mechanism in a direction of downward movement of said sheet feeding table;

detecting means for detecting when, during the upward movement of said sheet feeding table, said sheet feeding roller mechanism is lifted to a predetermined position against said urging means, to stop the upward movement of said sheet feeding table; and change-over means for changing the predetermined raised position of said sheet feeding roller mechanism which is obtained when said sheet feeding roller mechanism is detected by said detecting means, said change-over means having a movable member movable and lockable for operating said change-over means.

2. A sheet feeding apparatus according to claim 1, wherein said detecting means includes a sensor and a detection member to be detected, one of said sensor and said detection member is supported by said sheet feeding roller mechanism, the other is supported by a frame, and, in a direction of movement of said sheet feeding table, a relative position of a detecting section of said sensor and said detection member to be detected is changed according to a position of said movable member.

3. A sheet feeding apparatus according to claim 1, wherein said sheet feeding roller mechanism comprises:

a first roller firstly applying a feed force to the top of the sheets stacked on said sheet feeding table, and a second roller having a center shaft cooperating with a separating member provided on said frame to separate only the top of the sheets whose front edge portions are shifted from said sheet feeding table by said first roller, and feed said top sheet thus separated from said sheet feeding table, wherein said sheet feeding roller mechanism is pivotally supported by said center shaft.

4. A sheet feeding apparatus according to claim 1, further comprising:

sheet feeding pressure varying means for changing the urging force of said urging means according to a position of said movable member which is applied to said sheet feeding roller mechanism.

5. A sheet feeding apparatus according to claim 1, wherein said movable member for operating said change-over means can be moved to predetermined positions corresponding to at least one of a thickness and hardness of a sheet.

6. A sheet feeding apparatus according to claim 1, wherein said change-over means changes the raised position where said sheet feeding roller mechanism is detected by said detecting means corresponding to at least one of a thickness and hardness of a sheet.

7. A sheet feeding apparatus according to claim 1, wherein said movable member is a handle which is manually movable to discrete positions corresponding to at least one of a thickness and hardness of a sheet.

8. A sheet feeding apparatus, comprising:

a sheet feeding table on which sheets are stacked, said sheet feeding table being vertically movable;

a sheet feeding roller mechanism provided above said sheet feeding table, said sheet feeding roller mechanism having a scraper roller which is rotatably supported thereon and which is moved by said sheet feeding roller mechanism with respect to said sheet feeding table;

an urging spring urging said sheet feeding roller mechanism in a direction of downward movement of said sheet feeding table;

a detector for detecting when, during the upward movement of said sheet feeding table, said sheet feeding roller mechanism is lifted to a predetermined position against said urging spring, to stop the upward movement of said sheet feeding table; and a movable member movably supported by said sheet feeding roller mechanism, wherein a position where said detector detects that said sheet feeding table is lifted to the predetermined position is changed in accordance with a position of said movable member.

9. A sheet feeding apparatus according to claim 8, wherein said detector comprises:

a sensor provided on a frame; and a detection member to be detected provided on said sheet feeding roller mechanism, wherein said detection member connects to said movable member such that a relative position between said sensor and said detection member is changed in accordance with a position of said movable member.

10. A sheet feeding apparatus according to claim 8, wherein said detector comprises:

a detection member to be detected provided on a frame; and a sensor provided on said sheet feeding roller mechanism, wherein said sensor connects to said movable member such that a relative position between said detection member and said sensor is changed in accordance with a position of said movable member.

11. A sheet feeding apparatus according to claim 8, wherein said sheet feeding roller mechanism has a pickup roller having a shaft, and said shaft pivotally supports said sheet feeding roller mechanism and is supported on a frame.

12. A sheet feeding apparatus according to claim 8, further comprising:

an engaging piece provided with said sheet feeding roller mechanism;

a sheet feeding pressure hook pivotally movable, and selectively contactable with said engaging piece; and a pressure-changing spring provided between said sheet feeding pressure hook and said movable member, wherein an amount of strain of said pressure-changing spring is changed in accordance with the position of said movable member.

* * * * *